US010089951B2

(12) United States Patent
Park et al.

(10) Patent No.: US 10,089,951 B2
(45) Date of Patent: Oct. 2, 2018

(54) DISPLAY APPARATUS AND A METHOD OF DRIVING THE SAME

(71) Applicant: SAMSUNG DISPLAY CO., LTD., Yongin-si, Gyeonggi-Do (KR)

(72) Inventors: Hyang-A Park, Seoul (KR); Cheol-Woo Park, Suwon-si (KR); Seung-Hwan Park, Anyang-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 105 days.

(21) Appl. No.: 15/171,337

(22) Filed: Jun. 2, 2016

(65) Prior Publication Data

US 2017/0092216 A1 Mar. 30, 2017

(30) Foreign Application Priority Data

Sep. 24, 2015 (KR) ..... 10-2015-0135558

(51) Int. Cl.
*G09G 3/36* (2006.01)
*G09G 3/20* (2006.01)

(52) U.S. Cl.
CPC ..... *G09G 3/3685* (2013.01); *G09G 3/2018* (2013.01); *G09G 3/2074* (2013.01); *G09G 2300/0452* (2013.01); *G09G 2310/027* (2013.01); *G09G 2310/0286* (2013.01); *G09G 2310/0291* (2013.01); *G09G 2310/08* (2013.01); *G09G 2320/0247* (2013.01); *G09G 2320/0673* (2013.01)

(58) Field of Classification Search
None
See application file for complete search history.

(56) References Cited

U.S. PATENT DOCUMENTS

| | | | | |
|---|---|---|---|---|
| 8,711,172 | B2 * | 4/2014 | Bae | G09G 3/2055 345/596 |
| 2006/0119739 | A1 * | 6/2006 | Chang | G09G 3/2011 348/650 |
| 2007/0046600 | A1 * | 3/2007 | Sun | G09G 3/3688 345/89 |
| 2007/0188430 | A1 * | 8/2007 | Moon | G09G 3/3648 345/89 |
| 2014/0247289 | A1 | 9/2014 | Park et al. | |

* cited by examiner

*Primary Examiner* — Christopher Kohlman
(74) *Attorney, Agent, or Firm* — F. Chau & Associates, LLC

(57) ABSTRACT

A display apparatus includes a display panel including a first pixel, and a panel driver to generate a first data voltage based on a first or second gamma, to output the first data voltage to the first pixel, to generate a second data voltage based on a third or fourth gamma, and to output the second data voltage to the first pixel, wherein the first and second gammas are based on a first reference gamma, and the third and fourth gammas are based on a second reference gamma different from the first reference gamma, wherein a luminance of an image based on the first or second gammas is higher than a luminance of an image based on the first reference gamma, and wherein a data voltage based on the first gamma has a positive polarity, and a data voltage based on the second gamma has a negative polarity.

19 Claims, 9 Drawing Sheets

FIG. 5A

| GRAY | FIRST GAMMA(G1) | SECOND GAMMA(G2) |
|---|---|---|
| 32 | 83 | 47 |
| 64 | 91 | 55 |
| 96 | 101 | 59 |
| 128 | 112 | 66 |
| 160 | 125 | 75 |
| 192 | 144 | 88 |
| 224 | 178 | 118 |

FIG. 5B

| GRAY | THIRD GAMMA(G3) | FOURTH GAMMA(G4) |
|---|---|---|
| 32 | 74 | 64 |
| 64 | 85 | 70 |
| 96 | 95 | 77 |
| 128 | 108 | 84 |
| 160 | 122 | 95 |
| 192 | 139 | 109 |
| 224 | 176 | 146 |

DISPLAY APPARATUS AND A METHOD OF DRIVING THE SAME

CROSS-REFERENCE TO RELATED APPLICATION

This application claims priority under 35 U.S.C. § 119 to Korean Patent Application No. 10-2015-0135558, filed on Sep. 24, 2015 in the Korean Intellectual Property Office (KIPO), the disclosure of which is incorporated by reference herein in its entirety.

TECHNICAL FIELD

Exemplary embodiments of the present inventive concept relate to display devices, and more particularly to a display apparatus and a method of driving the display apparatus.

DESCRIPTION OF THE RELATED ART

A liquid crystal display (LCD) apparatus may include a first substrate including a pixel electrode, a second substrate including a common electrode, and a liquid crystal layer disposed between the first and second substrates. Voltages may be applied to the pixel electrode and the common electrode to generate an electric field in the liquid crystal layer. Transmittance of light passing through the liquid crystal layer may be controlled according to the electric field, and thus, an image may be displayed.

To enhance visibility of the LCD apparatus, a temporal gamma mixing (TGM) scheme may be employed. The TGM scheme may establish one frame set based on at least two frames and display an original image during the frame set by combining at least one frame image having a grayscale higher than that of the original image during at least one frame and at least one frame image having a grayscale lower than that of the original image during at least one frame. However, a moving artifact and/or a flicker may appear on the LCD apparatus operating based on the TGM scheme.

SUMMARY

A display apparatus according to an exemplary embodiment of the present inventive concept includes a display panel comprising a first pixel, and a panel driver configured to generate a first data voltage based on a first gamma or a second gamma, to output the first data voltage to the first pixel, to generate a second data voltage based on a third gamma or a fourth gamma, and to output the second data voltage to the first pixel, wherein the first gamma or the second gamma is based on a first reference gamma, and the third gamma or the fourth gamma is based on a second reference gamma different from the first reference gamma, wherein a luminance of an image based on the first gamma and the second gamma is higher than a luminance of an image based on the first reference gamma, and wherein a data voltage generated based on the first gamma has a positive polarity with respect to a first common voltage, and a data voltage generated based on the second gamma has a negative polarity with respect to the first common voltage.

In an exemplary embodiment of the present inventive concept, a luminance of an image based on the third gamma or the fourth gamma may be lower than a luminance of an image based on the second reference gamma, and a data voltage generated based on the third gamma may have a positive polarity with respect to a second common voltage, and a data voltage generated based on the fourth gamma may have a negative polarity with respect to the second common voltage.

In an exemplary embodiment of the present inventive concept, when the first data voltage is generated based on the first gamma, the second data voltage may be generated based on the fourth gamma, and when the first data voltage is generated based on the second gamma, the second data voltage may be generated based on the third gamma.

In an exemplary embodiment of the present inventive concept, each of the first and second common voltages may have a fixed level.

In an exemplary embodiment of the present inventive concept, the panel driver may comprise a timing controller configured to generate a gamma selection signal based on an input control signal, and a data driver configured to generate the first voltage based on the first gamma or the second gamma and the gamma selection signal, and to generate the second data voltage based on the third gamma or the fourth gamma and the gamma selection signal.

In an exemplary embodiment of the present inventive concept, the panel driver may further comprise a gamma reference voltage generator configured to generate a gamma reference voltage based on a gamma control signal, and to output the gamma reference voltage to the data driver, the gamma reference voltage including information about the first through fourth gammas.

In an exemplary embodiment of the present inventive concept, the data driver may comprise a gamma selection part configured to select the first gamma or the second gamma and the third gamma or the fourth gamma based on the gamma reference voltage and the gamma selection signal.

In an exemplary embodiment of the present inventive concept, the panel driver may comprise a timing controller configured to generate a data signal based on the first gamma or the second gamma and the third gamma or the fourth gamma, and a data driver configured to generate the first and second data voltages based on the data signal.

In an exemplary embodiment of the present inventive concept, the timing controller may comprise a gamma storing part configured to store the first through fourth gammas, a gamma controller configured to generate a gamma selection signal based on an input control signal, and an image processor configured to select the first gamma or the second gamma and the third gamma or the fourth gamma based on the gamma selection signal, and to generate the data signal based on input image data and the selected gammas.

In an exemplary embodiment of the present inventive concept, the panel driver may be configured to output the first data voltage to the first pixel in a first frame, and to output the second data voltage to the first pixel in a second frame based on a temporal gamma mixing (TGM) scheme, and the first pixel may display a first image in the first and second frames.

In an exemplary embodiment of the present inventive concept, the first pixel may comprise first and second sub-pixels, and the panel driver may be configured to output the first data voltage to the first sub-pixel in a first frame, and to output the second data voltage to the second sub-pixel in the first frame based on a spatial gamma mixing (SGM) scheme, and the first pixel may display a first image in the first frame.

A method of driving a display apparatus according to an exemplary embodiment of the present inventive concept includes generating a first data voltage based on a first gamma or a second gamma and outputting the first data voltage to a first pixel, and generating a second data voltage based on a third gamma or a fourth gamma and outputting the second data voltage to the first pixel, wherein the first gamma or the second gamma is based on a first reference gamma, and the third gamma or the fourth gamma is based on a second reference gamma different from the first reference gamma, wherein a luminance of an image based on the first gamma or the second gamma is higher than a luminance of an image based on the first reference gamma, and wherein a data voltage generated based on the first gamma has a positive polarity with respect to a first common voltage, and a data voltage generated based on the second gamma has a negative polarity with respect to the first common voltage.

In an exemplary embodiment of the present inventive concept, a luminance of an image based on the third gamma or the fourth gamma may be lower than a luminance of an image based on the second reference gamma, and a data voltage generated based on the third gamma may have a positive polarity with respect to a second common voltage, and a data voltage generated based on the fourth gamma may have a negative polarity with respect to the second common voltage.

In an exemplary embodiment of the present inventive concept, when the first data voltage is generated based on the first gamma, the second data voltage may be generated based on the fourth gamma, and when the first data voltage is generated based on the second gamma, the second data voltage may be generated based on the third gamma.

In an exemplary embodiment of the present inventive concept, each of the first and second common voltages may have a fixed level.

In an exemplary embodiment of the present inventive concept, the method may further comprise generating a gamma selection signal based on an input control signal, and generating the first data voltage based on the first gamma or the second gamma and the gamma selection signal, and generating the second data voltage based on the third gamma or the fourth gamma and the gamma selection signal.

In an exemplary embodiment of the present inventive concept, generating the first and second data voltages may comprise generating a gamma reference voltage including information about the first through fourth gammas based on a gamma control signal, and selecting the first gamma or the second gamma and the third gamma or the fourth gamma based on the gamma reference voltage and the gamma selection signal.

In an exemplary embodiment of the present inventive concept, the method may further comprise generating a data signal based on the first gamma or the second gamma and the third gamma or the fourth gamma, and generating the first and second data voltages based on the data signal.

A display apparatus according to an exemplary embodiment of the present inventive concept includes: a display panel comprising a first pixel; and a panel driver configured, in a first operating mode, to generate a first data voltage using a first gamma or a second gamma and to output the first data voltage to the first pixel in a first frame, and to generate a second data voltage using a third gamma or a fourth gamma and output the second data voltage to the first pixel in the second frame, the panel driver configured, in a second operating mode, to generate a third data voltage using the first gamma or the second gamma and to output the third data voltage to a first sub-pixel in a third frame, and to generate a fourth data voltage using the third gamma or the fourth gamma and to output the fourth data voltage to a second sub-pixel in the third frame.

In an exemplary embodiment of the present inventive concept, the first gamma or the second gammas may be based on a first reference gamma, and the third gamma or the fourth gamma may be based on a second reference gamma different from the first reference gamma.

BRIEF DESCRIPTION OF THE DRAWINGS

The above and other features of the present inventive concept will become more apparent by describing in detail exemplary embodiments thereof with reference to the accompanying drawings, in which:

FIGS. 5A and 5B are tables illustrating gammas according to exemplary embodiments of the present inventive concept;

DETAILED DESCRIPTION OF THE EMBODIMENTS

Hereinafter, exemplary embodiments of the present inventive concept will be explained in detail with reference to the accompanying drawings.

Figure 1:
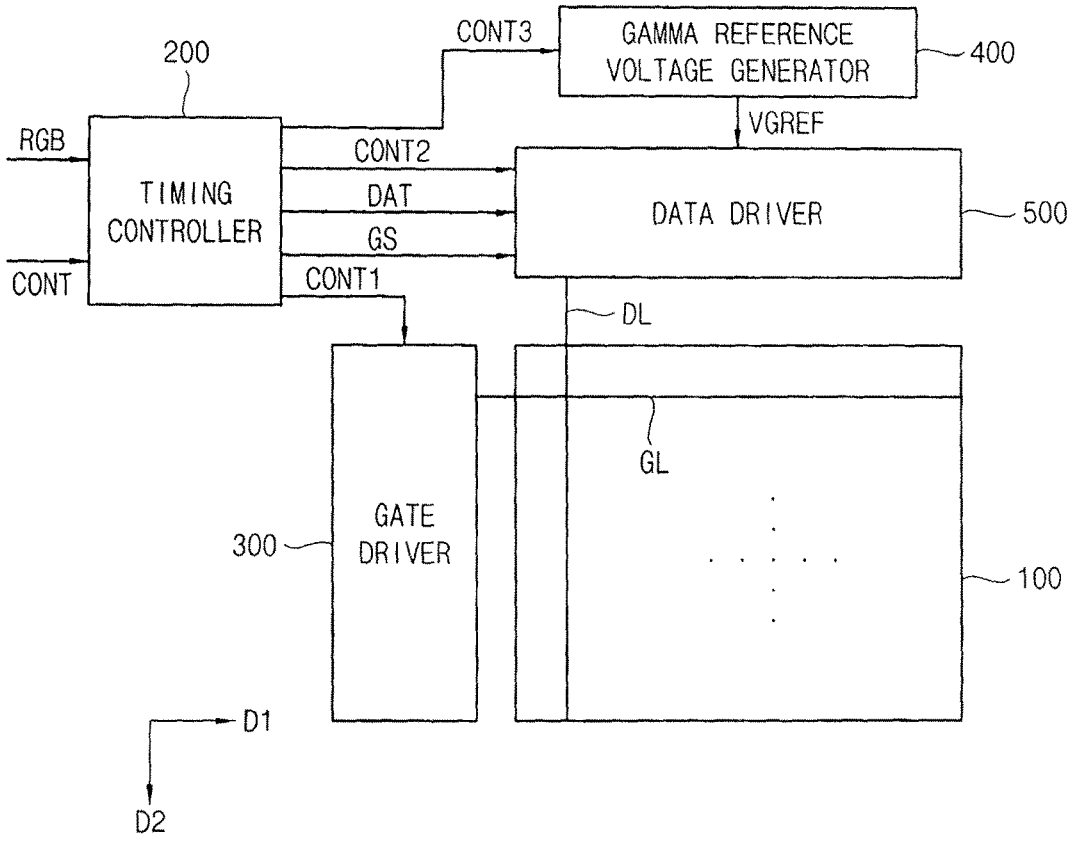
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400 and a data driver 500.

The display panel 100 includes a display region for displaying an image and a peripheral region adjacent to the display region.

The display panel 100 includes a plurality of gate lines GL, a plurality of data lines DL and a plurality of pixels connected to the gate lines GL and the data lines DL. The pixels include a first pixel. The gate lines GL extend in a first direction D1 and the data lines DL extend in a second direction D2 crossing the first direction D1.

In an exemplary embodiment of the present inventive concept, the pixels may include a switching element, a liquid crystal capacitor and a storage capacitor. The liquid crystal capacitor and the storage capacitor may be electrically connected to the switching element. The pixels may be arranged in a matrix configuration.

The timing controller 200 receives input image data RGB and an input control signal CONT from an external device. The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, a data signal DAT and a gamma selection signal GS based on the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DAT based on the input image data RGB. The timing controller 200 outputs the data signal DAT to the data driver 500. The data signal DAT may be substantially the same image data as the input image data RGB or the data signal DAT may be compensated image data generated by compensating the input image data RGB. For example, the timing controller 200 may selectively perform an image quality compensation, a spot compensation, an adaptive color correction (ACC), and/or a dynamic capacitance compensation (DCC) on the input image data RGB to generate the data signal DAT.

The timing controller 200 generates the gamma selection signal GS. The timing controller 200 outputs the gamma selection signal GS to the data driver 500. The gamma selection signal GS will be explained in detail with reference to FIGS. 2 and 3.

The timing controller 200 generates the third control signal CONT3 for controlling operations of the gamma reference voltage generator 400 based on the input control signal CONT, and outputs the third control signal CONT3 to the gamma reference voltage generator 400.

The operations of the timing controller 200 will be explained in detail with reference to FIG. 2.

The gate driver 300 generates gate signals for driving the gate lines GL in response to the first control signal CONT1 received from the timing controller 200. The gate driver 300 sequentially outputs the gate signals to the gate lines GL.

In an exemplary embodiment of the present inventive concept, the gate driver 300 may be directly mounted on the display panel 100, or may be connected to the display panel 100 as a tape carrier package (TCP) type. In addition, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT. The gamma reference voltage VGREF may include information about first through fourth gammas. The gamma reference voltage VGREF will be explained in detail with reference to FIGS. 4A, 4B, 5A and 5B.

In an exemplary embodiment of the present inventive concept, the gamma reference voltage generator 400 may be disposed in the timing controller 200, or may be disposed in the data driver 500.

The data driver 500 receives the second control signal CONT2, the data signal DAT and the gamma selection signal GS from the timing controller 200, and receives the gamma reference voltage VGREF from the gamma reference voltage generator 400. The data driver 500 converts the data signal DAT to data voltages having analog levels based on the gamma selection signal GS and the gamma reference voltage VGREF. The data driver 500 outputs the data voltages to the data lines DL.

In an exemplary embodiment of the present inventive concept, the data driver 500 may be directly mounted on the display panel 100, or may be connected to the display panel 100 as a TCP type. In addition, the data driver 500 may be integrated on the peripheral region of the display panel 100.

The operations of the data driver 500 will be explained in detail with reference to FIG. 3.

Figure 2:
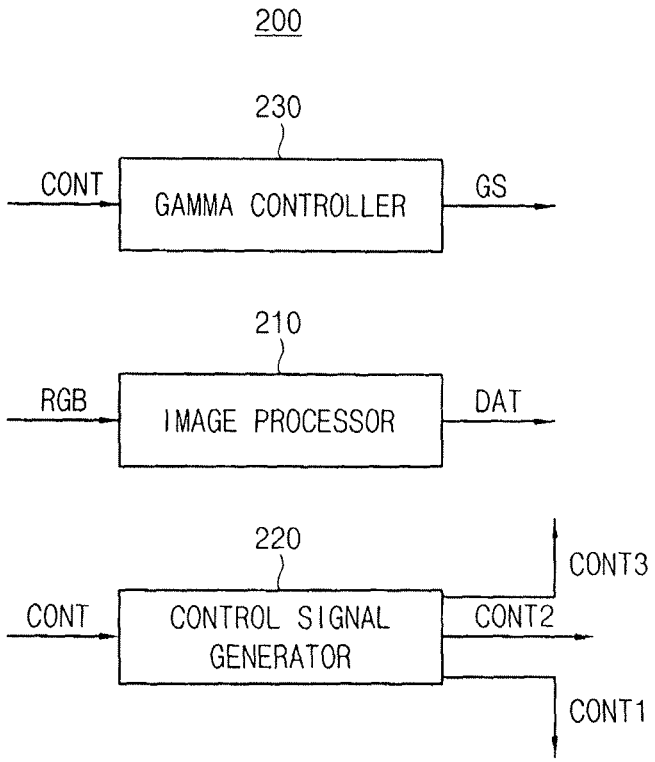
FIG. 2 is a block diagram illustrating a timing controller included in a display apparatus according to an exemplary embodiment of the present inventive concept.

FIG. 2 is a block diagram illustrating a timing controller included in a display apparatus according to an exemplary embodiment of the present inventive concept.

Referring to FIGS. 1 and 2, the timing controller 200 may include an image processor 210, a control signal generator 220 and a gamma controller 230.

The image processor 210 generates the data signal DAT based on the input image data RGB. The image processor 210 outputs the input image data RGB to the data driver 500.

The control signal generator 220 generates the first control signal CONT1, the second control signal CONT2 and the third control signal CONT3 based on the input control signal CONT. The control signal generator 220 outputs the first control signal CONT1 to the gate driver 300. The control signal generator 220 outputs the second control signal CONT2 to the data driver 500. The control signal generator 220 outputs the third control signal CONT3 to the gamma reference voltage generator 400.

The gamma controller 230 generates the gamma selection signal GS. The gamma controller 230 outputs the gamma selection signal GS to the data driver 500. The gamma selection signal GS will be explained in detail with reference to FIG. 3.

Figure 3:
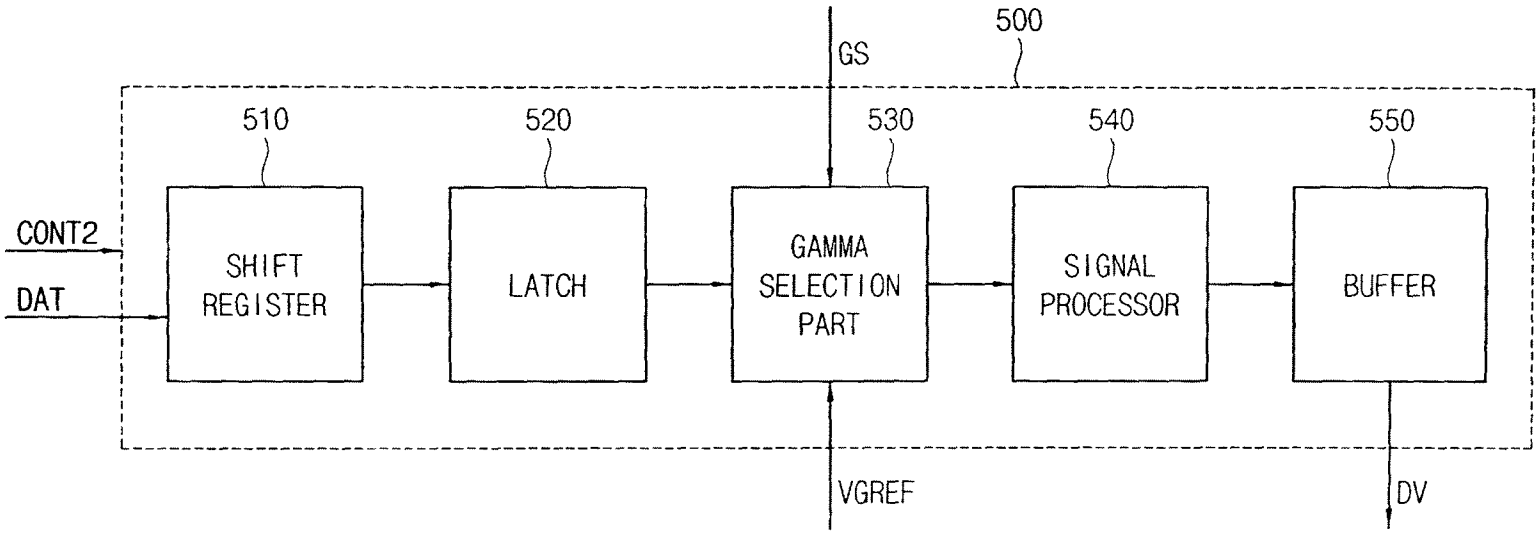
FIG. 3 is a block diagram illustrating a data driver included in a display apparatus according to an exemplary embodiment of the present inventive concept.

FIG. 3 is a block diagram illustrating a data driver included in a display apparatus according to an exemplary embodiment of the present inventive concept.

Referring to FIGS. 1 through 3, the data driver 500 may include a shift register 510, a latch 520, a gamma selection part 530, a signal processor 540 and a buffer 550.

The shift register 510 may receive the data signal DAT and output a latch pulse to the latch 520. For example, the latch pulse may include the data signal DAT. The latch 520 may temporarily store the data signal DAT and then may output the data signal DAT to the gamma selection part 530.

The gamma selection part 530 receives the gamma selection signal GS from the gamma controller 230. The gamma selection part 530 receives the gamma reference voltage VGREF from the gamma reference voltage generator 400.

The gamma reference voltage VGREF may include the information about the first through fourth gammas. The gamma selection part 530 may select one of the first and second gammas and one of the third and fourth gammas based on the gamma selection signal GS. The first through fourth gammas will be explained in detail with reference to FIGS. 4A, 4B, 5A and 5B.

The signal processor 540 may generate the data voltages DV having analog levels based on the data signal DAT having digital levels and the gamma selected by the gamma selection part 530 and may output the data voltages DV to the buffer 550. The buffer 550 may compensate the data voltages DV to have fixed levels and may output the data voltages DV to the data lines DL.

Figure 4A:
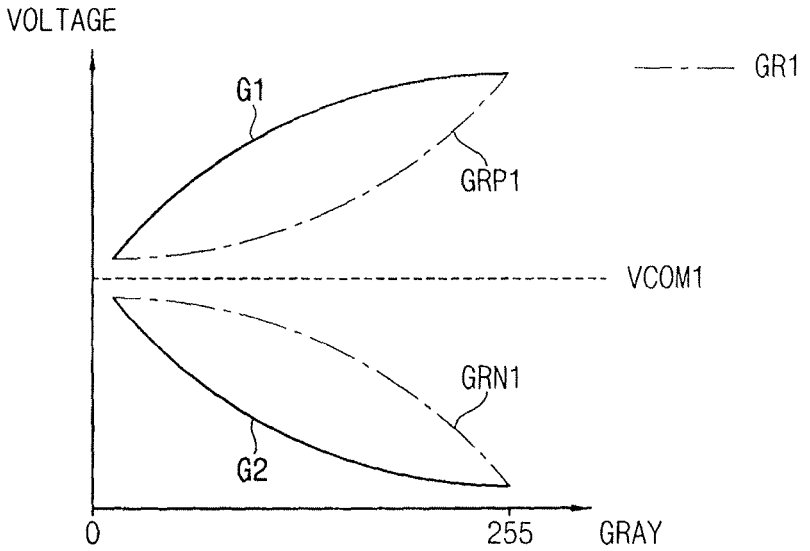
FIGS. 4A and 4B are graphs illustrating gamma curves according to exemplary embodiments of the present inventive concept.
Figure 4B:
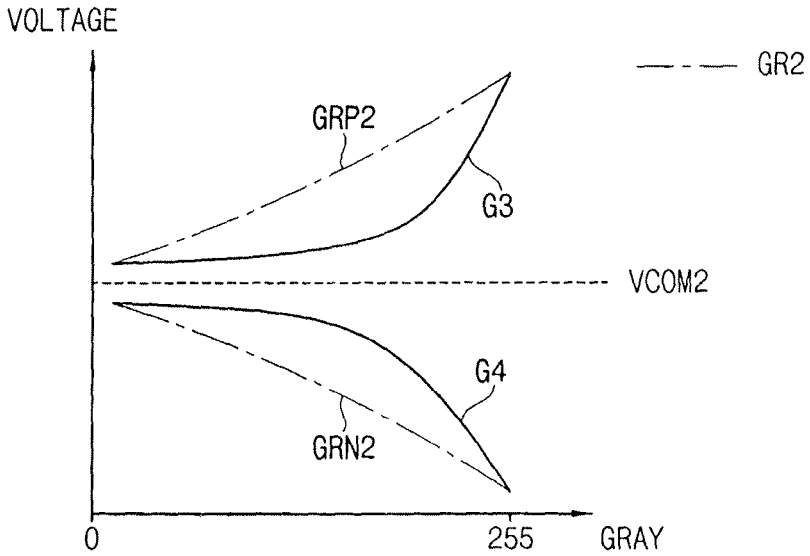

FIGS. 4A and 4B are graphs illustrating gamma curves according to exemplary embodiments of the present inventive concept. FIGS. 5A and 5B are tables illustrating gammas according to exemplary embodiments of the present inventive concept.

Referring to FIGS. 1 through 3, 4A, 4B, 5A and 5B, the gamma reference voltage VGREF may include the information about a first gamma G1, a second gamma G2, a third gamma G3 and a fourth gamma G4.

In FIGS. 4A and 4B, the x-axis corresponds to gray and the y-axis corresponds to voltage. In FIGS. 5A and 5B, gamma values for the first to fourth gammas G1 to G4 are shown. The gamma values correspond to particular gray values.

The first and second gammas G1, G2 may be based on a first reference gamma GR1. The first reference gamma GR1 may include a first positive reference gamma GRP1 and a first negative reference gamma GRN1. The first gamma G1 may be based on the first positive reference gamma GRP1. The second gamma G2 may be based on the first negative reference gamma GRN1. A data voltage generated based on the first gamma G1 may have a positive polarity with respect to a first common voltage Vcom1, and a data voltage generated based on the second gamma G2 may have a negative polarity with respect to the first common voltage Vcom1. The first gamma G1 and the second gamma G2 may be asymmetric to each other with respect to the first common voltage Vcom1. In FIG. 4A, a luminance increases, as a difference between a gamma voltage and the first common voltage Vcom1 increases. In other words, a luminance of an image based on the first gamma G1 may be higher than a luminance of an image based on the first positive reference gamma GRP1. A luminance of an image based on the second gamma G2 may be higher than a luminance of an image based on the first negative reference gamma GRN1.

In this case, the first common voltage Vcom1 may be set to have a fixed level.

The third and fourth gammas G3, G4 may be based on a second reference gamma GR2. The second reference gamma GR2 may be different from the first reference gamma GR1. The second reference gamma GR2 may include a second positive reference gamma GRP2 and a second negative reference gamma GRN2. The third gamma G3 may be based on the second positive reference gamma GRP2. The fourth gamma G4 may be based on the second negative reference gamma GRN2. A data voltage generated based on the third gamma G3 may have a positive polarity with respect to a second common voltage Vcom2, and a data voltage generated based on the fourth gamma G4 may have a negative polarity with respect to the second common voltage Vcom2. The third gamma G3 and the fourth gamma G4 may be asymmetric to each other with respect to the second common voltage Vcom2. In FIG. 4B, a luminance increases, as a difference between a gamma voltage and the second common voltage Vcom2 increases. In other words, a luminance of an image based on the third gamma G3 may be lower than a luminance of an image based on the second positive reference gamma GRP2. A luminance of an image based on the fourth gamma G4 may be lower than a luminance of an image based on the second negative reference gamma GRN2.

In this case, the second common voltage Vcom2 may be set to have a fixed level.

The gamma selection part 530 may select the first gamma G1 or the second gamma G2 based on the gamma selection signal GS. The signal processor 540 may output the first data voltage based on the selected gamma. The buffer 550 may output the first data voltage to a first pixel.

The gamma selection part 530 may select the third gamma G3 or the fourth gamma G4 based on the gamma selection signal GS. The signal processor 540 may output the second data voltage based on the selected gamma. The buffer 550 may output the second data voltage to the first pixel.

The data driver 500, based on a temporal gamma mixing (TGM) scheme, may output the first data voltage to the first pixel in a first frame and may output the second data voltage to the first pixel in a second frame. In this case, the first pixel may display a first image in the first and second frames.

In addition, the data driver 500, based on a spatial gamma mixing (SGM) scheme, may output the first data voltage to a first sub-pixel included in the first pixel in a first frame and may output the second data voltage to a second sub-pixel included in the first pixel in the first frame. In this case, the first pixel may display the first image in the first frame.

A method of driving the display apparatus based on the TGM and SGM schemes will be explained with reference to FIGS. 6A and 6B.

Figure 6A:
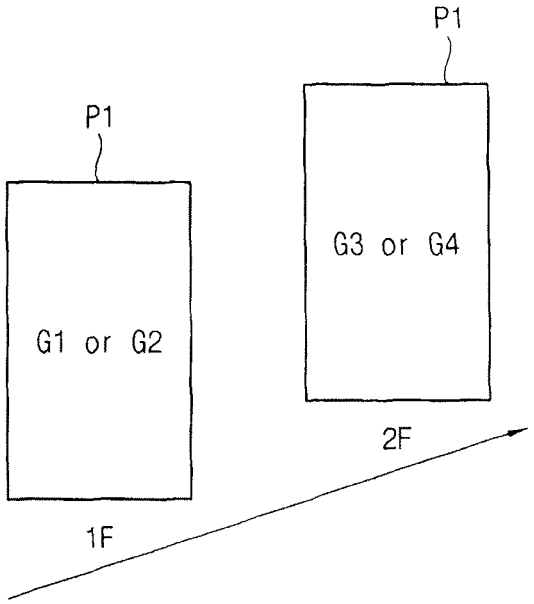
FIG. 6A is a diagram illustrating gammas corresponding to a first pixel in a temporal gamma mixing (TGM) scheme according to an exemplary embodiment of the present inventive concept.

FIG. 6A is a diagram illustrating gammas corresponding to a first pixel in a TGM scheme according to an exemplary embodiment of the present inventive concept.

Referring to FIGS. 1 through 3, 4A, 4B and 6A, one frame set may include a first frame 1F and a second frame 2F. A first data voltage generated based on one of the first and second gammas G1, G2 may be outputted to a first pixel P1 in the first frame 1F. A second data voltage generated based on one of the third and fourth gammas G3, G4 may be outputted to the first pixel P1 in the second frame 2F. The first pixel P1 may display a first image in the first and second frames 1F, 2F.

Figure 6B:
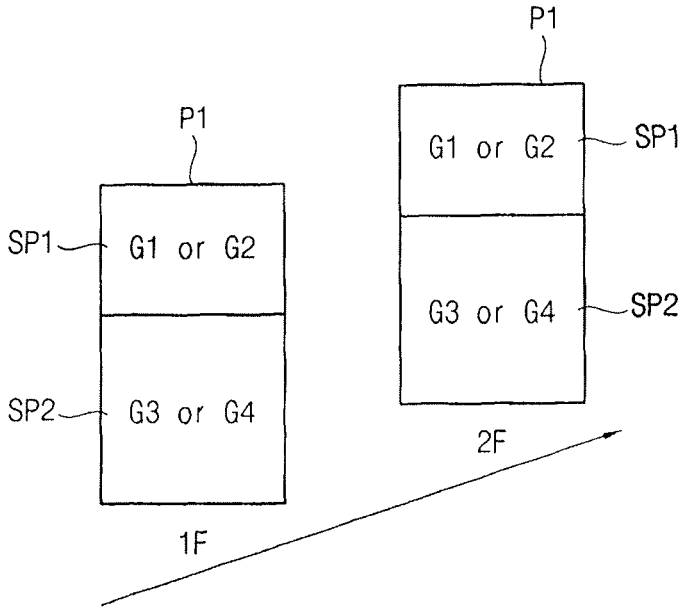
FIG. 6B is a diagram illustrating gammas corresponding to a first pixel in a spatial gamma mixing (SGM) scheme according to an exemplary embodiment of the present inventive concept.

FIG. 6B is a diagram illustrating gammas corresponding to a first pixel in an SGM scheme according to an exemplary embodiment of the present inventive concept.

Referring to FIGS. 1 through 3, 4A, 4B and 6B, a first pixel P1 may include a first sub-pixel SP1 and a second sub-pixel SP2. A first data voltage generated based on one of the first and second gammas G1, G2 may be outputted to the first sub-pixel SP1 in a first frame 1F. A second data voltage generated based on one of the third and fourth gammas G3, G4 may be outputted to the second sub-pixel SP2 in the first frame 1F. The first pixel P1 may display a first image in the first frame. A similar set of events may occur in a second frame 2F.

Figure 7:
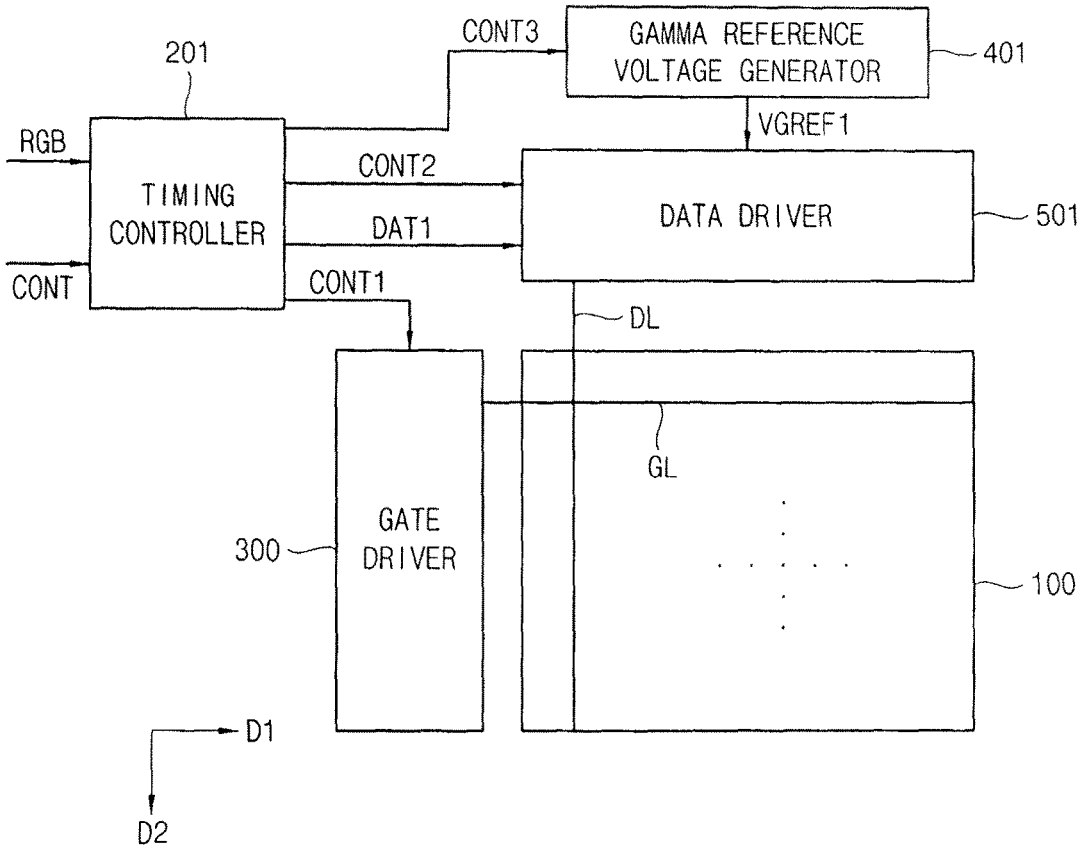
FIG. 7 is a block diagram illustrating a display apparatus according to an exemplary embodiment of the present inventive concept.

FIG. 7 is a block diagram illustrating a display apparatus according to an exemplary embodiment of the present inventive concept. Hereinafter, any repetitive explanation concerning FIG. 1 may be omitted, since like reference numerals in FIGS. 1 and 7 may designate like elements.

Referring to FIG. 7, the display apparatus includes a display panel 100 and a panel driver. The panel driver includes a timing controller 201, a gate driver 300, a gamma reference voltage generator 401 and a data driver 501.

The timing controller 201 generates a first control signal CONT1, a second control signal CONT2, a third control signal CONT3 and a data signal DAT1 based on the input image data RGB and the input control signal CONT.

The timing controller 201 generates the data signal DAT1 based on the input image data RGB. The timing controller 201 outputs the data signal DAT1 to the data driver 501. The data signal DAT1 may be based on one of a first gamma and a second gamma and one of a third gamma and a fourth gamma.

The operations of the timing controller 201 will be explained in detail with reference to FIG. 8.

The gamma reference voltage generator 401 generates a gamma reference voltage VGREF1 in response to the third control signal CONT3 received from the timing controller 201. The gamma reference voltage generator 401 outputs the gamma reference voltage VGREF1 to the data driver 501. The level of the gamma reference voltage VGREF1 corresponds to grayscales of a plurality of pixel data included in the data signal DAT1.

The data driver 501 receives the second control signal CONT2 and the data signal DAT1 from the timing controller 201, and receives the gamma reference voltage VGREF1 from the gamma reference voltage generator 401. The data driver 501 converts the data signal DAT1 to data voltages having analog levels based on the gamma reference voltage VGREF1. The data driver 501 outputs the data voltages to the data lines DL.

The operations of the data driver 501 will be explained in detail with reference to FIG. 9.

Figure 8:
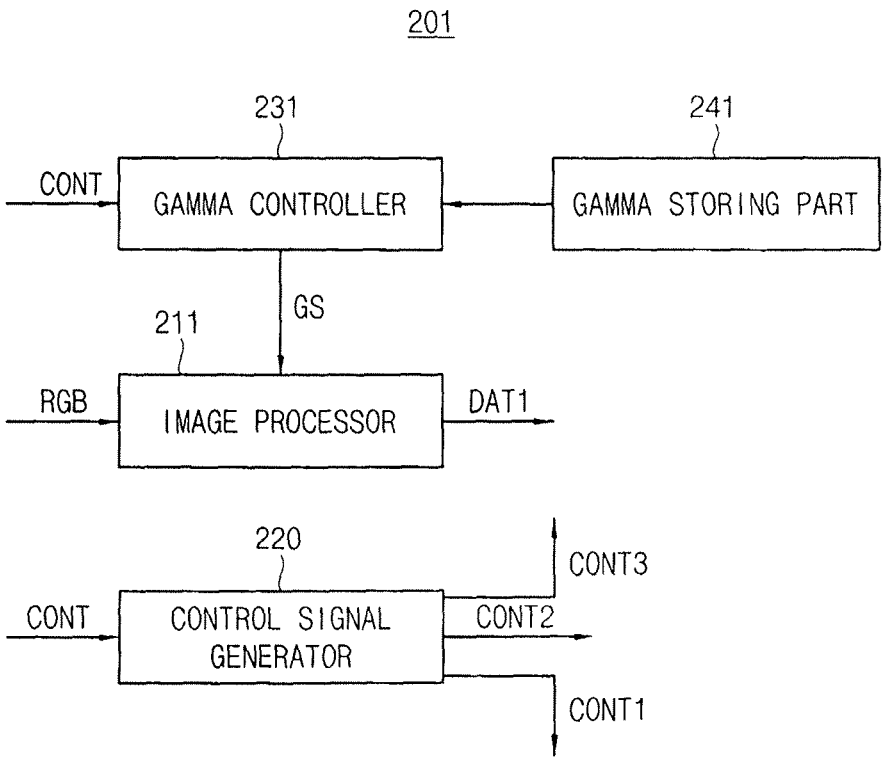
FIG. 8 is a block diagram illustrating a timing controller included in a display apparatus according to an exemplary embodiment of the present inventive concept.

FIG. 8 is a block diagram illustrating a timing controller included in a display apparatus according to an exemplary embodiment of the present inventive concept. Hereinafter, any repetitive explanation concerning FIG. 2 will be omitted, since like reference numerals in FIGS. 2 and 8 may designate like elements.

Referring to FIGS. 7 and 8, the timing controller 201 may include an image processor 211, a control signal generator 220, a gamma controller 231 and a gamma storing part 241.

The gamma storing part 241 stores first through fourth gammas. The first through fourth gammas are substantially the same as those explained in FIGS. 4A and 4B. The gamma storing part 241 may store the first through fourth gammas corresponding to each of the grayscales like that shown in FIGS. 5A and 5B.

The gamma controller 231 generates a gamma selection signal GS using information in the gamma storing part 241. The gamma controller 231 outputs the gamma selection signal GS to the image processor 211.

The image processor 211 generates the data signal DAT1 based on the input image data RGB and the gamma selection signal GS. The image processor 211 generates the data signal DAT1 based on one of the first and second gammas and one of the third and fourth gammas. For example, the image processor 211 may generate a data signal corresponding to a first pixel in a first frame based on one of the first and second gammas. The image processor 211 may generate a data signal corresponding to the first pixel in a second frame based on one of the third and fourth gammas. The image processor 211 outputs the data signal DAT1 to the data driver 500.

The control signal generator 220 generates the first control signal CONT1, the second control signal CONT2 and the third control signal CONT3 based on the input control signal CONT. The control signal generator 220 outputs the first control signal CONT1 to the gate driver 300. The control signal generator 220 outputs the second control signal CONT2 to the data driver 501. The control signal generator 220 outputs the third control signal CONT3 to the gamma reference voltage generator 401.

Figure 9:
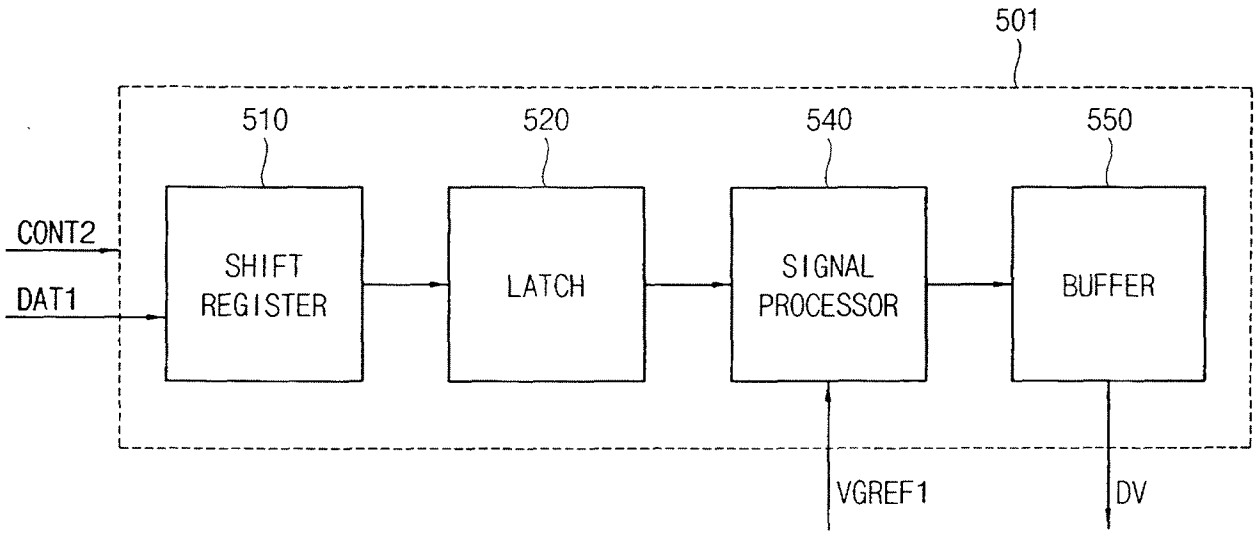
FIG. 9 is a block diagram illustrating a data driver included in a display apparatus according to an exemplary embodiment of the present inventive concept.

FIG. 9 is a block diagram illustrating a data driver included in a display apparatus according to an exemplary embodiment of the present inventive concept. Hereinafter, any repetitive explanation concerning FIG. 3 will be omitted, since like reference numerals in FIGS. 3 and 9 may designate like elements.

Referring to FIGS. 7 through 9, the data driver 501 may include a shift register 510, a latch 520, a signal processor 540 and a buffer 550.

The shift register 510 may receive the data signal DAT1 and output a latch pulse to the latch 520. For example, the latch pulse may include the data signal DAT1. The latch 520 may temporarily store the data signal DAT1 and then may output the data signal DAT1 to the signal processor 540.

The signal processor 540 may generate the data voltages DV having analog levels based on the data signal DAT1 having digital levels to output the data voltages DV to the buffer 550. The signal processor 540 may receive the gamma reference voltage VGREF1 from the gamma reference voltage generator 401. The gamma reference voltage VGREF1 may include information about a plurality of gammas. The data voltages DV may be based in part on at least one of the gammas. The buffer 550 may compensate the data voltages DV to have fixed levels and may output the data voltages DV to the data lines DL.

The display apparatus according to FIGS. 7 through 9 may be driven based on a TGM scheme or a SGM scheme, as explained in reference to FIGS. 6A and 6B The above described exemplary embodiments of the present inventive concept may be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

According to exemplary embodiments of the present inventive concept, a high gamma and a low gamma have different reference gammas in a TGM or an SGM scheme so that optimal common voltages of each of the high and low gammas have fixed levels. Thus, display quality of a display panel can be increased.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A display apparatus, comprising:

a display panel comprising a first pixel; and a panel driver configured to generate a first data voltage based on a first gamma or a second gamma, to output the first data voltage to the first pixel, to generate a second data voltage based on a third gamma or a fourth gamma, and to output the second data voltage to the first pixel, wherein the first gamma or the second gamma is based on a first reference gamma, and the third gamma or the fourth gamma is based on a second reference gamma different from the first reference gamma, wherein the first reference gamma includes a first positive reference gamma curve and a first negative reference gamma curve, and the second reference gamma includes a second positive reference gamma curve and a second negative reference gamma curve, wherein a luminance of an image based on the first gamma or the second gamma is higher than a luminance of an image based on the first reference gamma in an entire range of a gray scale represented by the display panel, and wherein a data voltage generated based on the first gamma has a positive polarity with respect to a first common voltage, and a data voltage generated based on the second gamma has a negative polarity with respect to the first common voltage.

2. The display apparatus of claim 1, wherein a luminance of an image based on the third gamma or the fourth gamma is lower than a luminance of an image based on the second reference gamma, and wherein a data voltage generated based on the third gamma has a positive polarity with respect to a second common voltage, and a data voltage generated based on the fourth gamma has a negative polarity with respect to the second common voltage.

3. The display apparatus of claim 2, wherein when the first data voltage is generated based on the first gamma, the second data voltage is generated based on the fourth gamma, and wherein when the first data voltage is generated based on the second gamma, the second data voltage is generated based on the third gamma.

4. The display apparatus of claim 1, wherein each of the first and second common voltages has a fixed level.

5. The display apparatus of claim 1, wherein the panel driver comprises:

a timing controller configured to generate a gamma selection signal based on an input control signal; and a data driver configured to generate the first voltage based on the first gamma or the second gamma and the gamma selection signal, and to generate the second data voltage based on the third gamma or the fourth gamma and the gamma selection signal.

6. The display apparatus of claim 5, wherein the panel driver further comprises:

a gamma reference voltage generator configured to generate a gamma reference voltage based on a gamma control signal, and to output the gamma reference voltage to the data driver, the gamma reference voltage including information about the first through fourth gammas.

7. The display apparatus of claim 6, wherein the data driver comprises:

a gamma selection part configured to select the first gamma or the second gamma and the third gamma or the fourth gamma based on the gamma reference voltage and the gamma selection signal.

8. The display apparatus of claim 1, wherein the panel driver comprises:

a timing controller configured to generate a data signal based on the first gamma or the second gamma and the third gamma or the fourth gamma; and a data driver configured to generate the first and second data voltages based on the data signal.

9. The display apparatus of claim 8, wherein the timing controller comprises:

a gamma storing part configured to store the first through fourth gammas;

a gamma controller configured to generate a gamma selection signal based on an input control signal; and an image processor configured to select the first gamma or the second gamma and the third gamma or the fourth gamma based on the gamma selection signal, and to generate the data signal based on input image data and the selected gammas.

10. The display apparatus of claim 1, wherein the panel driver is configured to output the first data voltage to the first pixel in a first frame, and to output the second data voltage to the first pixel in a second frame based on a temporal gamma mixing (TGM) scheme, and the first pixel displays a first image in the first and second frames.

11. The display apparatus of claim 1, wherein the first pixel comprises first and second sub-pixels, and the panel driver is configured to output the first data voltage to the first sub-pixel in a first frame, and to output the second data voltage to the second sub-pixel in the first frame based on a spatial gamma mixing (SGM) scheme, and the first pixel displays a first image in the first frame.

12. A method of driving a display apparatus, the method comprising:

generating a first data voltage based on a first gamma or a second gamma and outputting the first data voltage to a first pixel; and generating a second data voltage based on a third gamma or a fourth gamma and outputting the second data voltage to the first pixel, wherein the first gamma or the second gamma is based on a first reference gamma, and the third gamma or the fourth gamma is based on a second reference gamma different from the first reference gamma, wherein the first reference gamma includes a first positive reference gamma and a first negative reference gamma, and the second reference gamma includes a second positive reference gamma and a second negative reference gamma, wherein a luminance of an image based on the first gamma or the second gamma is higher than a luminance of an image based on the first reference gamma in an entire range of a gray scale represented by the display apparatus, and wherein a data voltage generated based on the first gamma has a positive polarity with respect to a first common voltage, and a data voltage generated based on the second gamma has a negative polarity with respect to the first common voltage.

13. The method of claim 12, wherein a luminance of an image based on the third gamma or the fourth gamma is lower than a luminance of an image based on the second reference gamma, and wherein a data voltage generated based on the third gamma has a positive polarity with respect to a second common voltage, and a data voltage generated based on the fourth gamma has a negative polarity with respect to the second common voltage.

14. The method of claim 13, wherein when the first data voltage is generated based on the first gamma, the second data voltage is generated based on the fourth gamma, and wherein when the first data voltage is generated based on the second gamma, the second data voltage is generated based on the third gamma.

15. The method of claim 12, wherein each of the first and second common voltages has a fixed level.

16. The method of claim 12, further comprising:

generating a gamma selection signal based on an input control signal; and generating the first data voltage based on the first gamma or the second gamma and the gamma selection signal, and generating the second data voltage based on the third gamma or the fourth gamma and the gamma selection signal.

17. The method of claim 16, wherein generating the first and second data voltages comprises:

generating a gamma reference voltage including information about the first through fourth gammas based on a gamma control signal; and selecting the first gamma or the second gamma and the third gamma or the fourth gammas based on the gamma reference voltage and the gamma selection signal.

18. The method of claim 12, further comprising:

generating a data signal based on the first gamma or the second gamma and the third gamma or the fourth gamma; and generating the first and second data voltages based on the data signal.

19. A display apparatus, comprising:

a display panel comprising a first pixel; and a panel driver configured, in a first operating mode, to generate a first data voltage using a first gamma or a second gamma and to output the first data voltage to the first pixel in a first frame, and to generate a second data voltage using a third gamma or a fourth gamma and output the second data voltage to the first pixel in the second frame, the panel driver configured, in a second operating mode, to generate a third data voltage using the first gamma or the second gamma and to output the third data voltage to a first sub-pixel in a third frame, and to generate a fourth data voltage using the third gamma or the fourth gamma and to output the fourth data voltage to a second sub-pixel in the third frame, the first gamma and the second gamma being asymmetric to each other with respect to a first common voltage, and the third gamma and the fourth gamma being asymmetric to each other with respect to a second common voltage, wherein the first gamma or the second gamma is based on a first reference gamma, and the third gamma or the fourth gamma is based on a second reference gamma different from the first reference gamma, wherein a luminance of an image based on the first gamma or the second gamma is higher than a luminance of an image based on the first reference gamma in an entire range of gray scale represented by the display panel.

* * * * *